US009186639B2

(12) United States Patent
Broderick

(10) Patent No.: US 9,186,639 B2
(45) Date of Patent: Nov. 17, 2015

(54) DISPOSABLE LINER FOR CONE OF DRUM LIFTER/INVERTER MIXING MACHINE

(71) Applicant: Clifford Broderick, Newburgh, NY (US)

(72) Inventor: Clifford Broderick, Newburgh, NY (US)

( * ) Notice: Subject to any disclaimer, the term of this patent is extended or adjusted under 35 U.S.C. 154(b) by 330 days.

(21) Appl. No.: 13/856,495

(22) Filed: Apr. 4, 2013

(65) Prior Publication Data

US 2013/0292384 A1 Nov. 7, 2013

Related U.S. Application Data

(60) Provisional application No. 61/638,640, filed on Apr. 26, 2012, provisional application No. 61/623,688, filed on Apr. 13, 2012.

(51) Int. Cl.

| | |
|---|---|
| ***B01F 15/00*** | (2006.01) |
| ***B01F 9/00*** | (2006.01) |
| ***B01F 9/02*** | (2006.01) |

(52) U.S. Cl.

CPC ..... *B01F 15/00837* (2013.01); *B01F 9/0018* (2013.01); *B01F 9/02* (2013.01)

(58) Field of Classification Search

CPC ..... B01F 15/00837
USPC ..... 220/495.01, 495.05, 495.1
See application file for complete search history.

(56) References Cited

U.S. PATENT DOCUMENTS

| | | | | |
|---|---|---|---|---|
| 2,511,481 | A | 6/1950 | Schneider | |
| 2,566,838 | A | 9/1951 | Hurt | |
| 2,755,971 | A | 7/1956 | Lisciani | |
| 3,147,041 | A | 9/1964 | Howcroft | |
| 4,106,133 | A | 8/1978 | Roberts | |
| 4,658,989 | A | 4/1987 | Bonerb | |
| 5,661,873 | A | 9/1997 | Karet | |
| 5,964,371 | A | 10/1999 | McCabe | |
| 6,517,155 | B1 | 2/2003 | Landine | |
| 6,532,605 | B1 | 3/2003 | Howell | |
| 7,607,819 | B2 | 10/2009 | Gaeta | |
| 7,913,873 | B2 | 3/2011 | Van Handel | |
| 2006/0000013 | A1 | 1/2006 | Peoples | |
| 2007/0034219 | A1 | 2/2007 | Affinito | |
| 2007/0180636 | A1 | 8/2007 | Rosquist | |
| 2011/0174823 | A1 * | 7/2011 | Silva | 220/476 |
| 2013/0283519 | A1 | 10/2013 | Holden | |

* cited by examiner

*Primary Examiner* — David Sorkin
(74) *Attorney, Agent, or Firm* — Thomas A. O'Rourke; Booner & O'Rourke, LLP

(57) ABSTRACT

A disposable liner, used with a cone-shaped funnel of a drum lifter/inverter mixing/discharge machine, may include a first liner portion formed into a hollow cylinder having a first diameter and a first thickness. The first liner portion transitions into a second portion that is formed into a conical shape, with a first end formed to the first diameter, and with a second end formed to a second diameter being larger than the first diameter. The second portion is formed with a plurality of openings positioned a small distance away from the second end and are spaced equally spaced about a third diameter of the second portion. Each the openings are formed to a special elliptical shape, with a corresponding elliptically formed grommet, to be configured to be preloaded with respect to the center of corresponding buttons on the cone, onto which the openings may be received to mount the liner.

4 Claims, 14 Drawing Sheets

| DRUM SIZE CLAMPING RANGE | | |
|---|---|---|
| DIAMETER | MIN. HT. | MAX. HT. |
| 300mm | 883mm | 965mm |
| 350mm | 841mm | 965mm |
| 400mm | 798mm | 965mm |
| 450mm | 755mm | 965mm |
| 500mm | 712mm | 965mm |
| 550mm | 669mm | 965mm |
| 600mm | 627mm | 965mm |

TABLE 1

DISPOSABLE LINER FOR CONE OF DRUM LIFTER/INVERTER MIXING MACHINE

CROSS REFERENCES TO RELATED APPLICATIONS

This application claims priority on U.S. Provisional Application Ser. No. 61/638,640 filed on Apr. 13, 2012, and U.S. Provisional Application Ser. No. 61/623,688, filed Apr. 26, 2012, with the disclosures of each being incorporated herein by reference.

FIELD OF THE INVENTION

The present invention relates to improvements in apparatus and methods for industrial mixing, and more particularly to a liner and corresponding apparatus which are capable of reducing loss and waste of ingredients trapped in such apparatus.

BACKGROUND OF THE INVENTION

There are a wide range of consumer and industrial products whose manufacture requires one or more steps, where the mixing of large batches of constituent materials or ingredients must occur. Various improvements in this technical area are shown, for example, by: U.S. Pat. No. 5,246,290 to Bolz for "Cone Mixer With Swivel Arm Drive and Sealing Arrangement Lubricated By An External Lubricant Receptacle"; by U.S. Pat. No. 5,649,765 to Stokes for "Conical Mixer Apparatus with Contamination-Preventing Orbit Ann Assembly"; and by U.S. Pat. No. 7,160,023 to Freude for "System for Detachably Coupling a Drive to a Mixer Mounted in a Portable Tank."

A critical aspect of such mixing of the component parts of a composition of matter, particularly for pharmaceutical products, is that the proportions be within certain tolerances, and preferably be as close to an ideal mixture of such ingredients as possible. One difficulty encountered in any type of mixer is that in attempting to aggregate those constituent ingredients from individual containers, there are losses. The losses may occur by the trapping of perceptible amounts of each ingredient within respective containers, especially during the pouring process. Also, the amount of loss that occurs may vary for each material, depending on, for example, the ingredient's viscosity, the ambient temperature, and other conditions, making pre-determined adjustments to maintain the mixture's integrity not completely/repeatably accurate.

The invention disclosed herein reduces the losses resulting from the mixing of components in the manufacture of commercial batches of a product, and thereby serves to attain a reproducible, and consistently accurate blend of ingredients.

OBJECTS OF THE INVENTION

It is an object of the invention to reduce or alleviate waste in commercial mixing of the ingredients of a product.

It is another object of the invention to improve the consistency and accuracy of the relative proportions of the constituent components within a commercial mixture.

It is a further object of the invention to provide a disposable liner for use in combination with a cone-shaped funnel of a lifter/inverter device for maneuvering and emptying of drums containing chemical components.

It is another object of the invention to provide a lifter/inverter device that may be used to seal a drum of chemical components, against a liner of a cone-shaped funnel of the device, to permit inverting and pouring of the chemicals in the drum over the liner and through the neck of the cone-shaped funnel.

Further objects and advantages of the invention will become apparent from the following description and claims, and from the accompanying drawings.

SUMMARY OF THE INVENTION

A drum lifter/inverter machine of the present invention includes a stanchion, with an arm cantilevered therefrom that is capable of being elevated above a floor. The free end of the arm has a pivotable cradle assembly to support a drum that may contain ingredients to be mixed with other components, to blend a pharmaceutical product or another commercial product. Thus the arm and stanchion may be used to lift a drain of ingredients above a mixing container, and to also rotate the drum into an inverted position. A cone member may be pivotally attached to the cradle assembly, and may be pivot about either one of two hinge pins. Prior to inversion of the drum by the device, the cone may be pivoted about a horizontal hinge pin to permit installation therein of a special liner of the present invention. The liner facilitates more complete removal of the material discharged therefrom, and is disposable to reduce cleaning time. The cone may be reverse pivoted about that horizontal hinge pin. Pivoting of the cone about a vertical hinge pin permits the cradle assembly to be secured to the drum. Reverse pivoting of the cone about the vertical hinge pin then positions it to be in-line with the drum. After elevating and inverting the drum using the stanchion and arm, a flow control valve may be actuated to permit flow of the material from the drum and through the liner/cone, and into the mixing container, After returning the drum to the floor, the cone may be pivoted and the liner removed for disposal.

Figure 1:
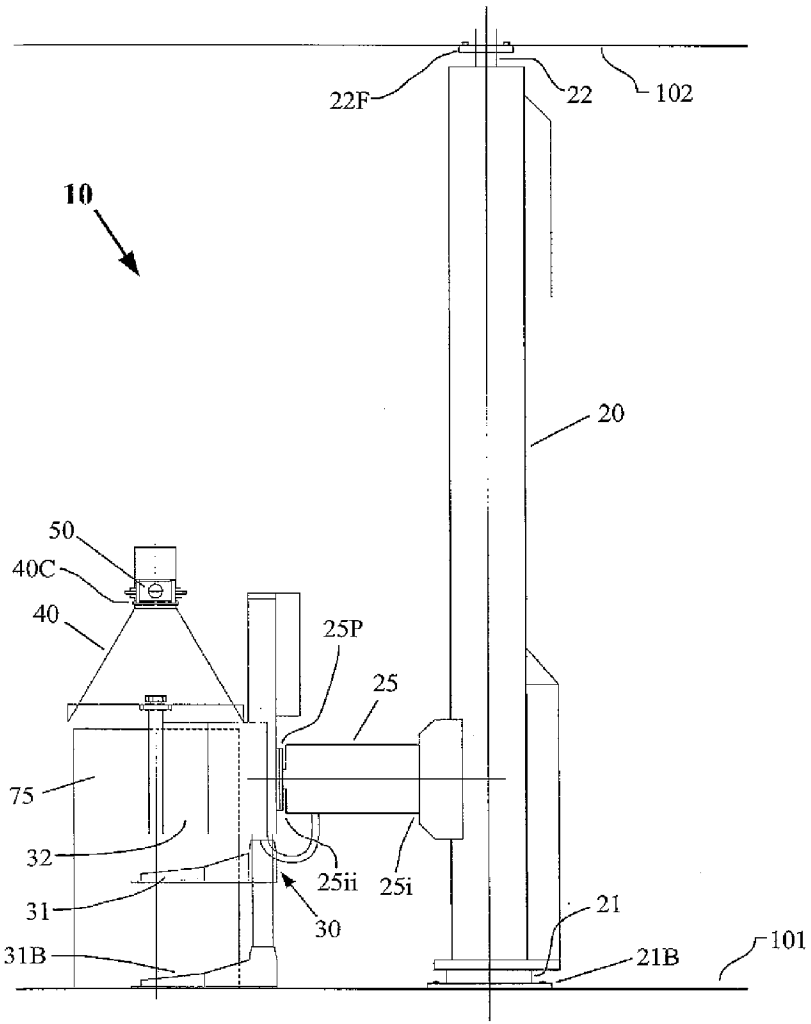
FIG. 1 is a side view of a drum lifter/inverter machine, having a cradle configured to receive a drum filled with an ingredient, and having a cone-shaped funnel that may releasably receive the liner of the present invention to minimize losses experienced in emptying the chemical components contained in the drum.
Figure 1B:
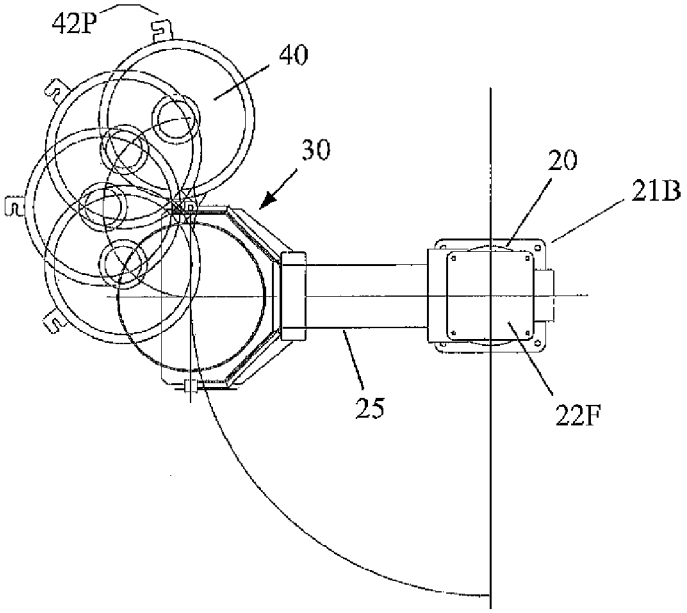
FIG. 1B is a top view of the drum lifter/inverter machine of FIG. 1A, showing the cone of the inverter pivoting from a position distal from the drum, to a position directly above and in-line with the drum.
Figure 1A:
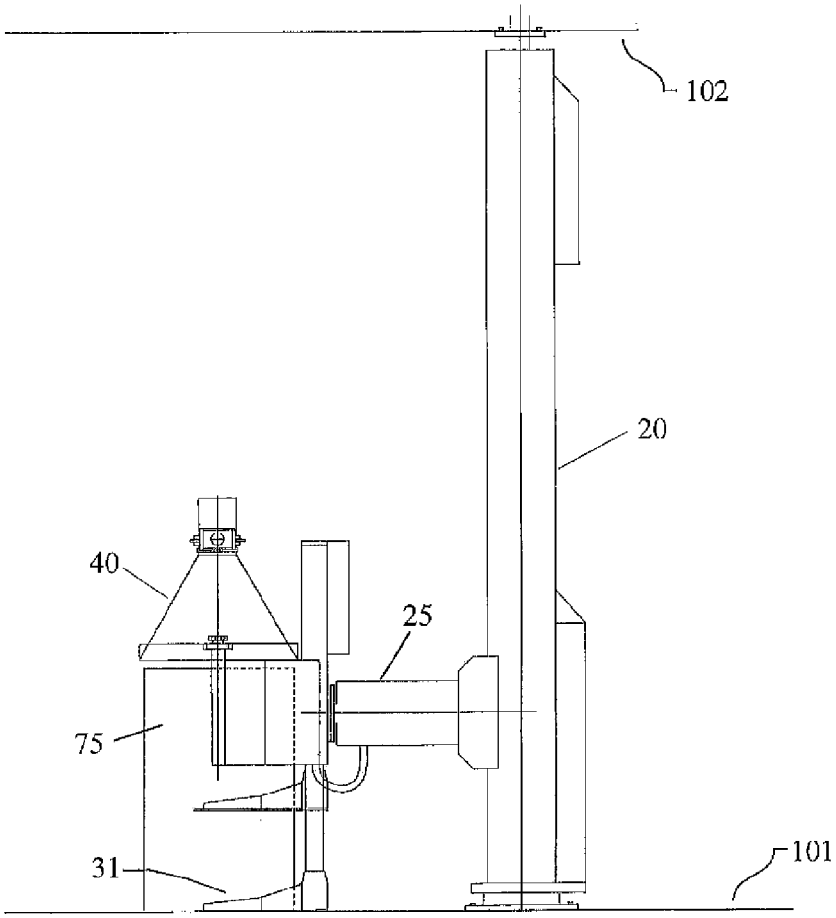
FIG. 1A is the side view of FIG. 1, but shown reduced in size.
Figure 1C:
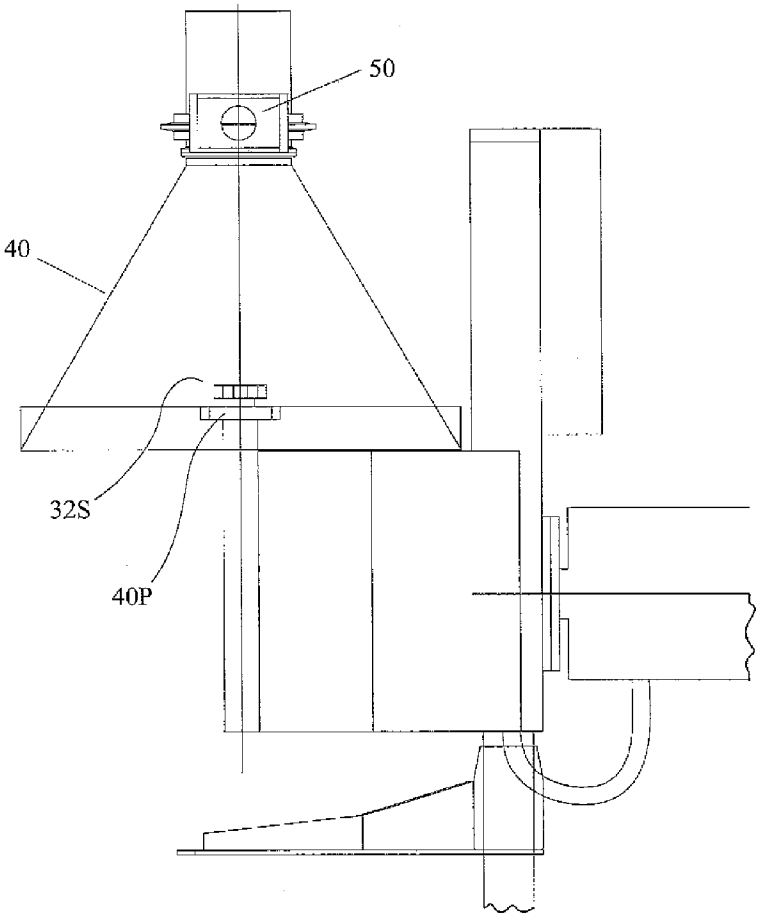
FIG. 1C is an enlarged detail view of the cone of the drum lifter/inverter machine of FIG. 1A.
Figure 1D:
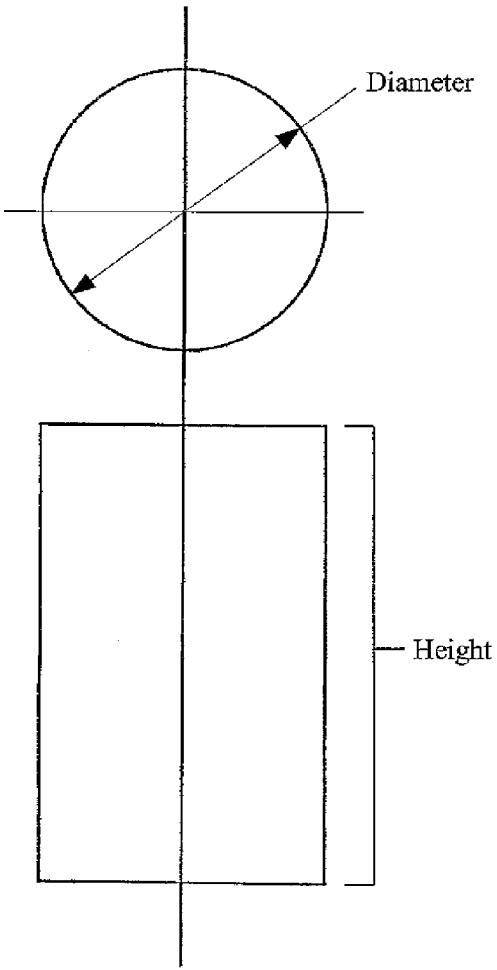
FIG. 1D is a side view and corresponding top view of a drum that is usable with the cradle of the drum lifter/inverter machine of FIG. 1.

TABLE 1 lists dimensions illustrative of some of the drum sizes for the drum of FIG. 1D that could be handled by the cradle of the drum lifter/inverter machine of FIG. 1.

Figure 2:
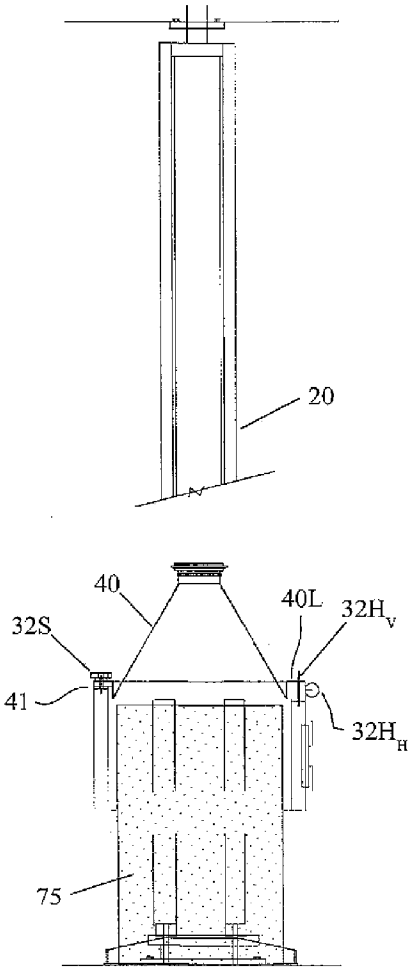

FIG. 2 is a front view of the drum lifter/inverter machine of FIG. 1, and is shown with a drum full of chemical components, prior to being clamped to the cone.

Figure 3:
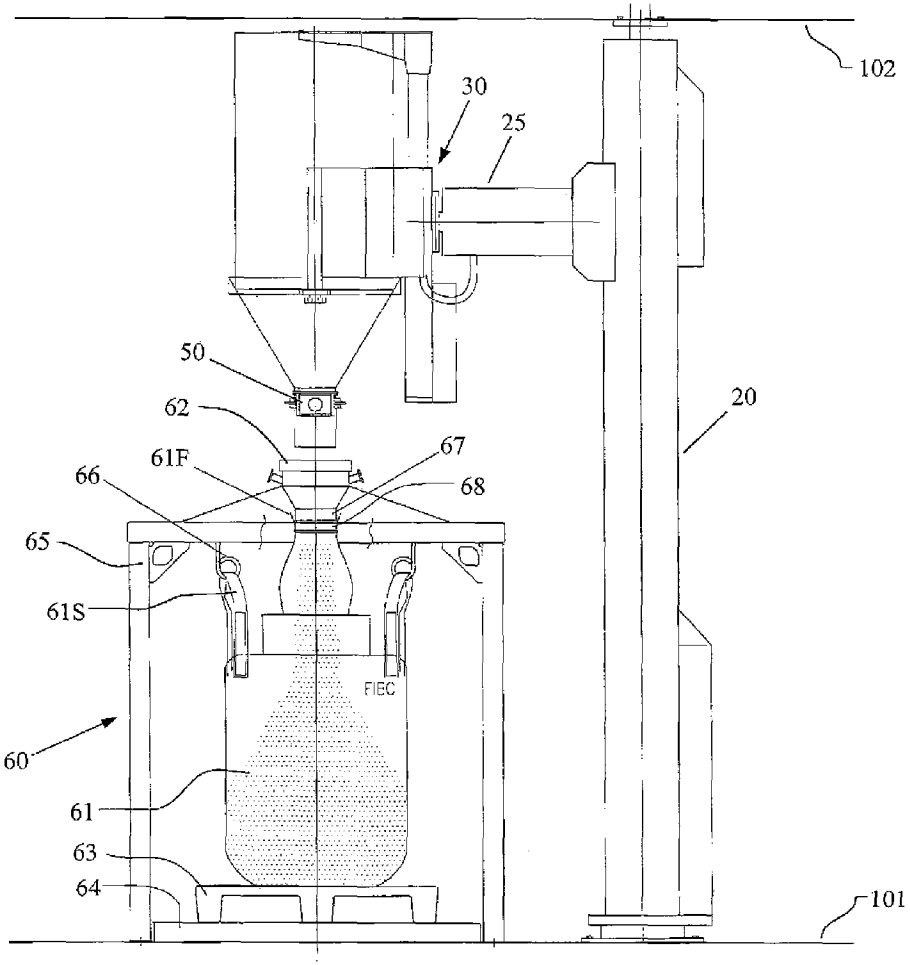

FIG. 3 is the front view of the drum lifter/inverter apparatus of FIG. 1, but showing the inverter having elevated and rotated the drum that is held within the cradle by 180 degrees, and after being rotated about the stanchion to be positioned over a flexible intermediate bulk container (FIBC).

Figure 4:
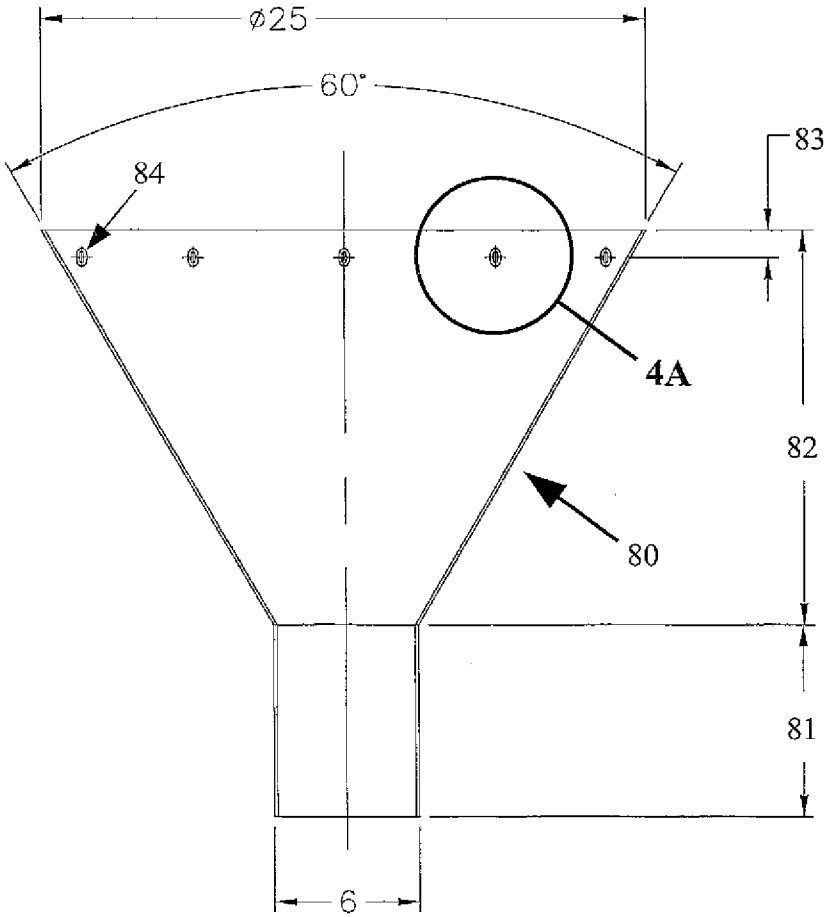
Figure 4A:
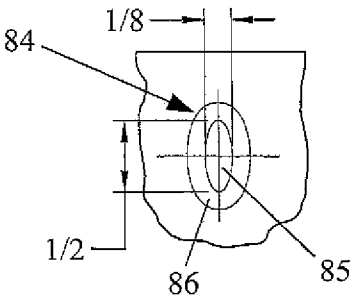

FIG. 4 is a side view of a disposable liner of the present invention that is usable with the cone-shaped funnel of the drum lifter/inverter machine of FIG. 1, FIG. 4A is an enlarged detail view of the integral grommet at the large conical end of the liner of FIG. 4.

Figure 4B:
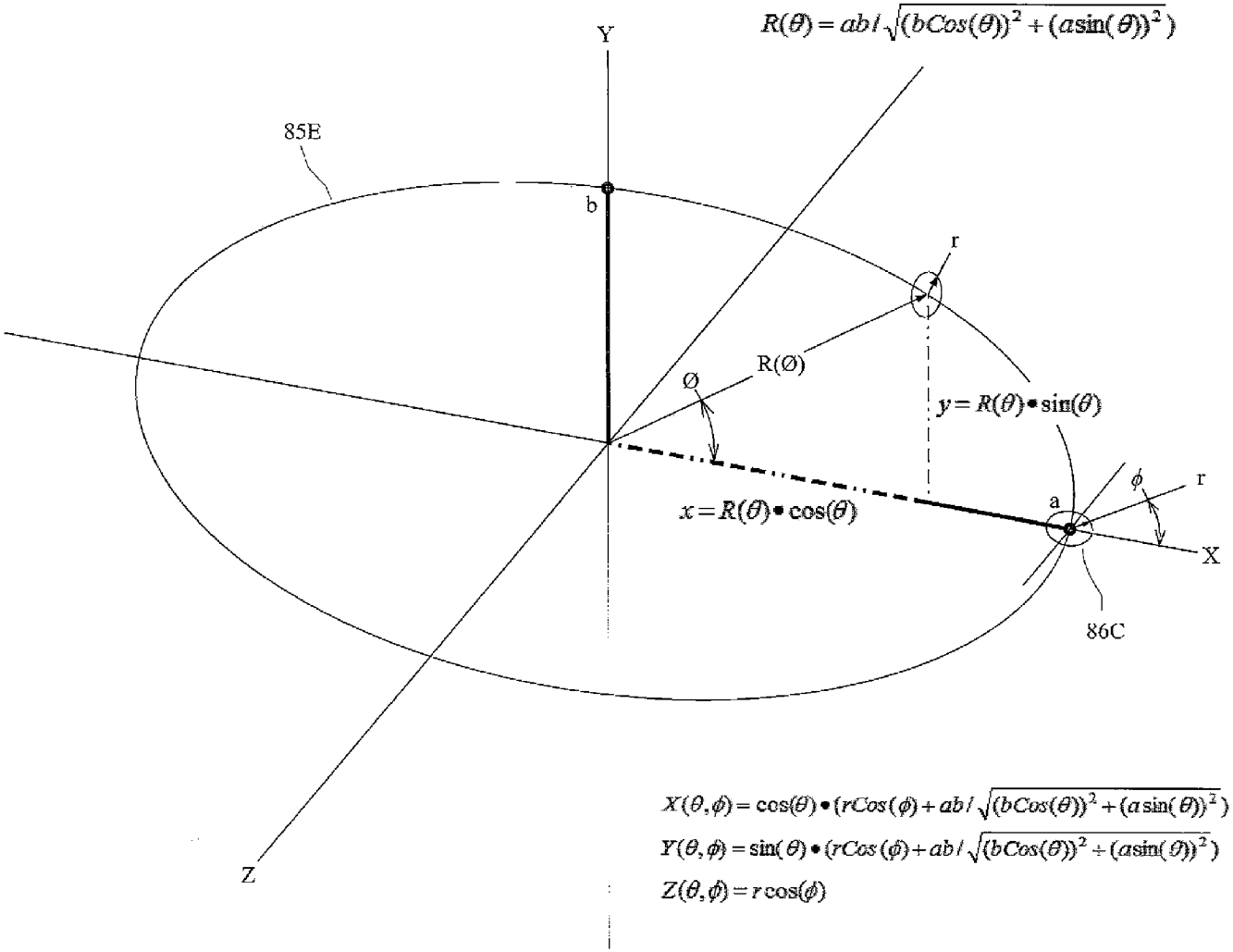

FIG. 4B is a diagram illustrating curves and equations that define and describe the integral grommet of FIG. 4A.

Figure 5:
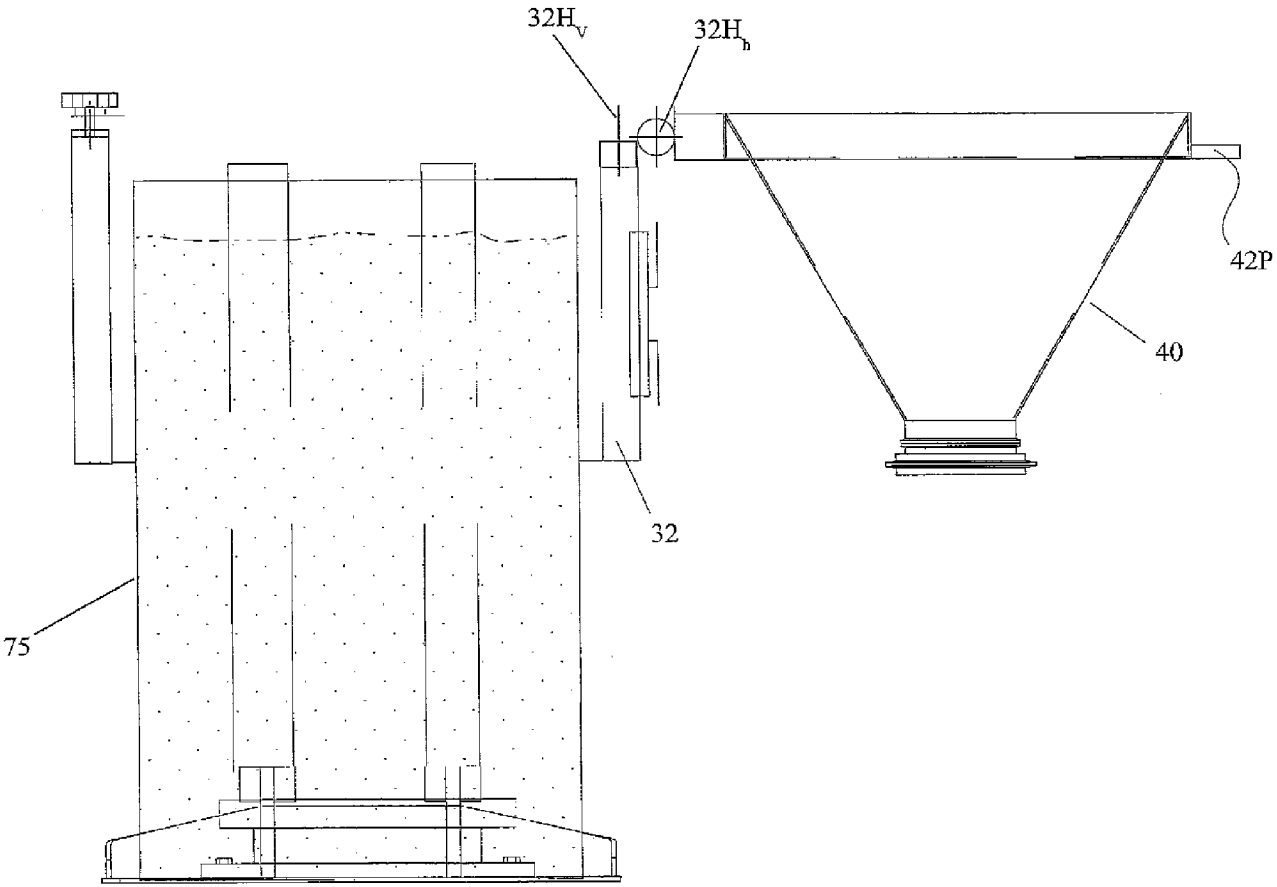

FIG. 5 shows the drum, cradle, and cone-shaped funnel of FIG. 2, but with the cone having been rotated 180 degrees away from the drum.

Figure 6:
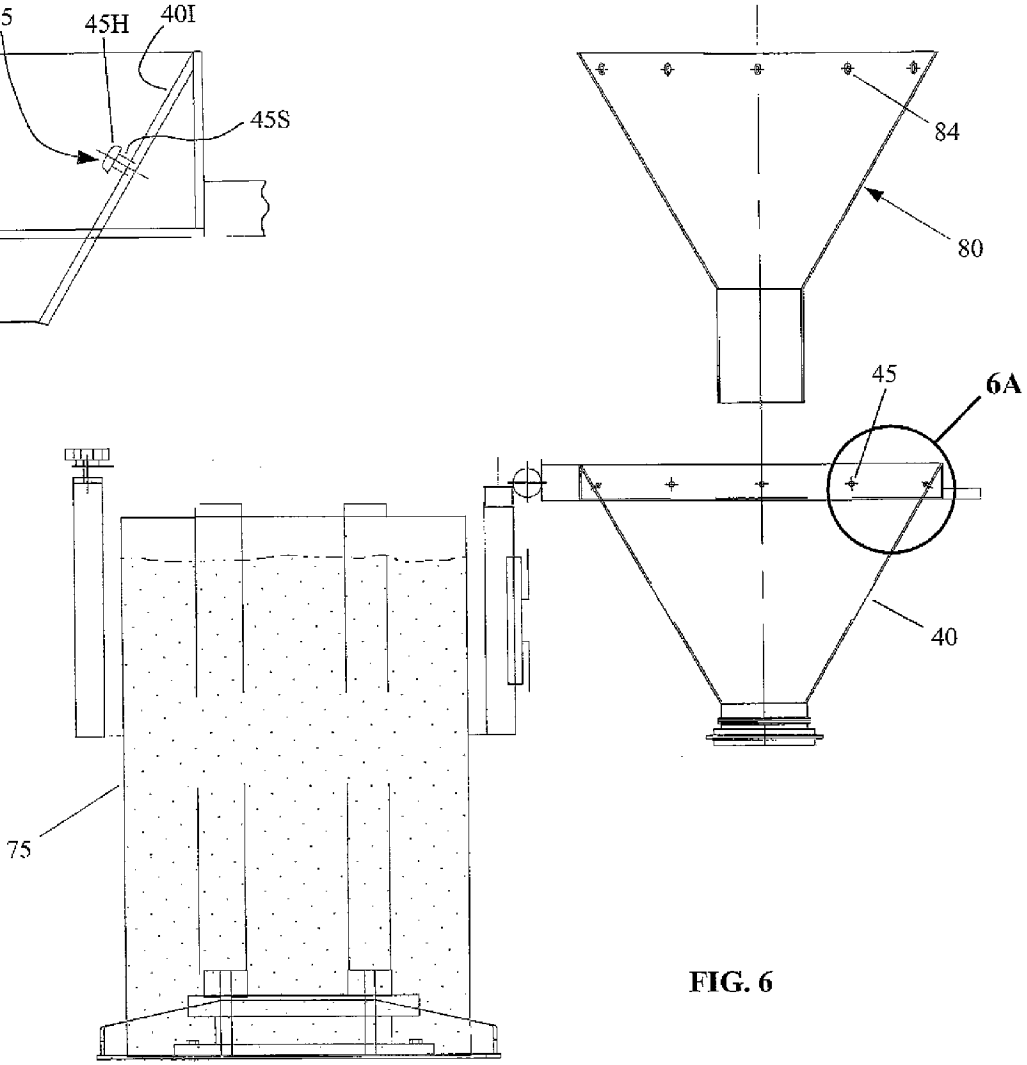

FIG. 6 is the view of FIG. 5, but showing the liner of the present invention just prior to insertion into the cone.

Figure 6A:
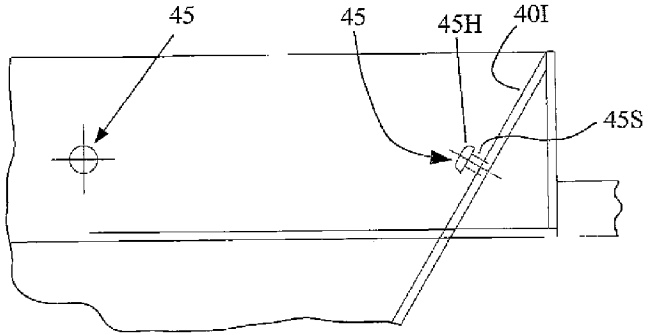

FIG. 6A is an enlarged detail view of the mounting buttons on the cone-shaped funnel, which are usable for receiving the reinforced openings of the disposable liner.

Figure 7:
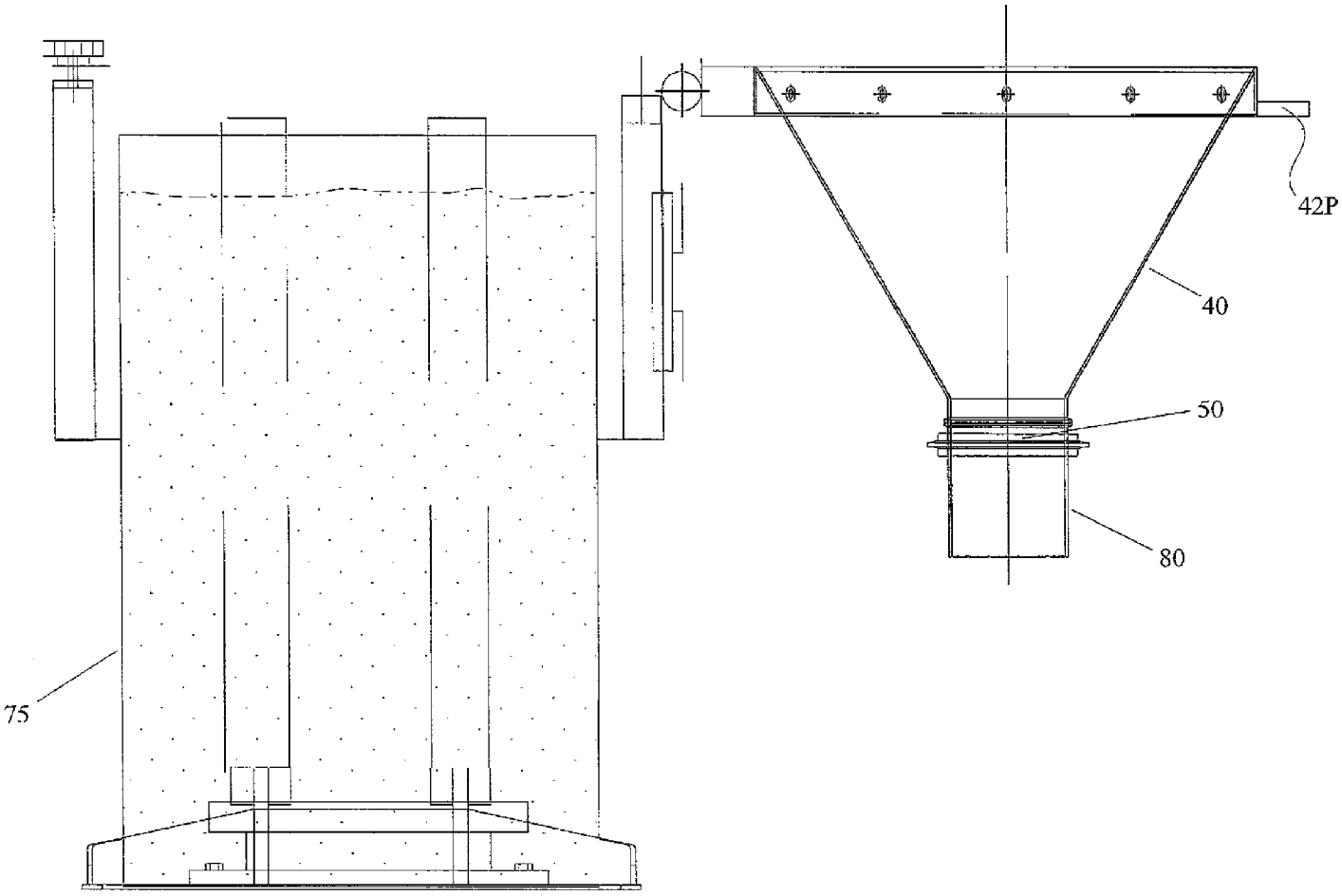

FIG. 7 is the view of FIG. 6, after the liner has been inserted into the cone, and the liner's reinforced opening have been respectively secured to the welded buttons on the cone-shaped funnel's interior surface.

Figure 8:
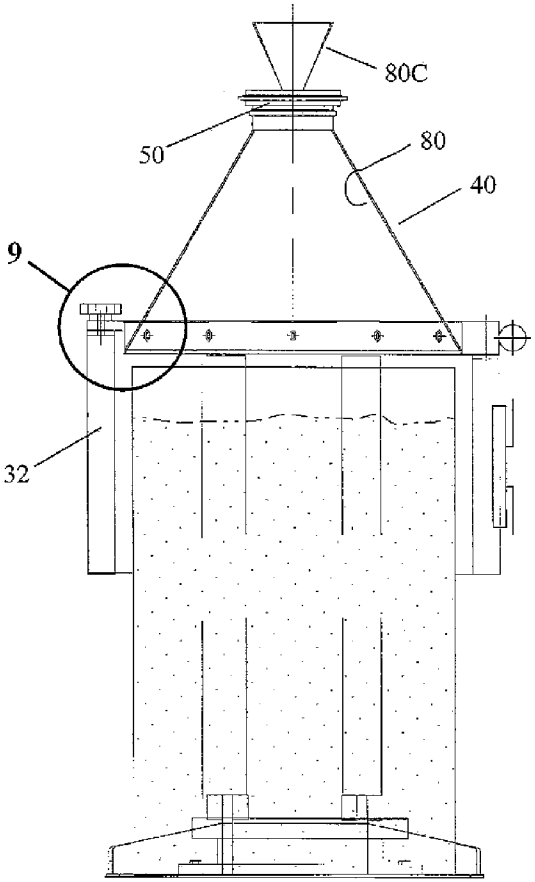

FIG. 8 is the view of FIG. 7, but showing the cone-shaped funnel having been counter-rotated 180 degrees to again be positioned over the drum, and with the valve of the cone-shaped funnel having been closed to crimp the liner to prevent unintended outflow of chemicals therefrom.

Figure 9:
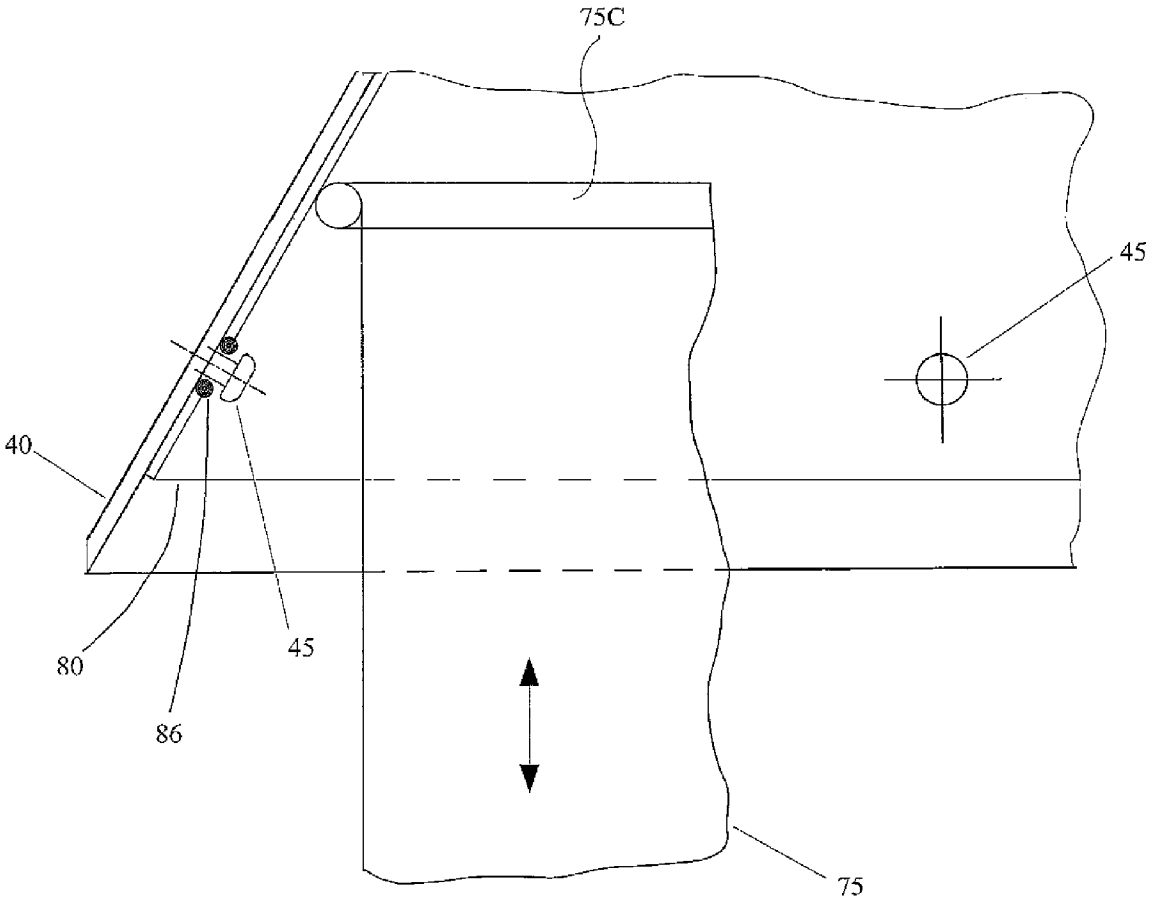

FIG. 9 is an enlarged detail view of the drum/cone/liner interface on the left side of the arrangement in FIG. 8.

Figure 10A:
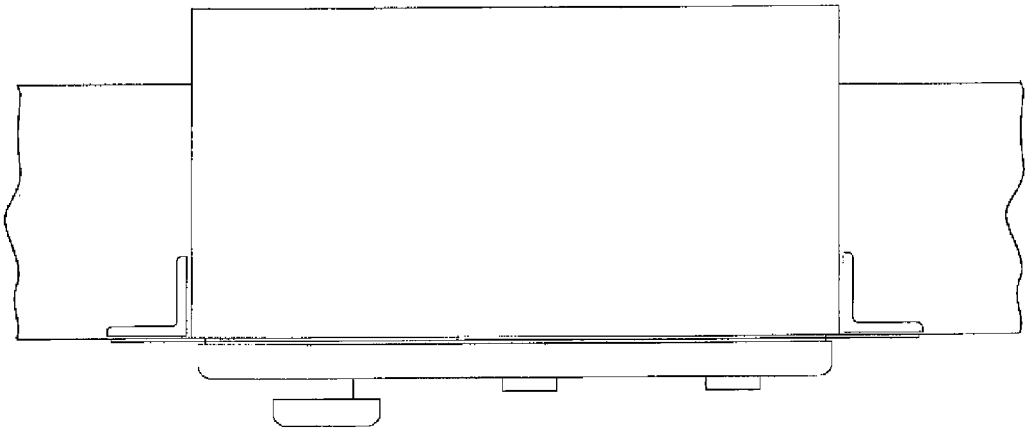

FIG. 10A is a side view of the operator/power panel of the drum lifter/inverter machine of FIG. 1.

Figure 10B:
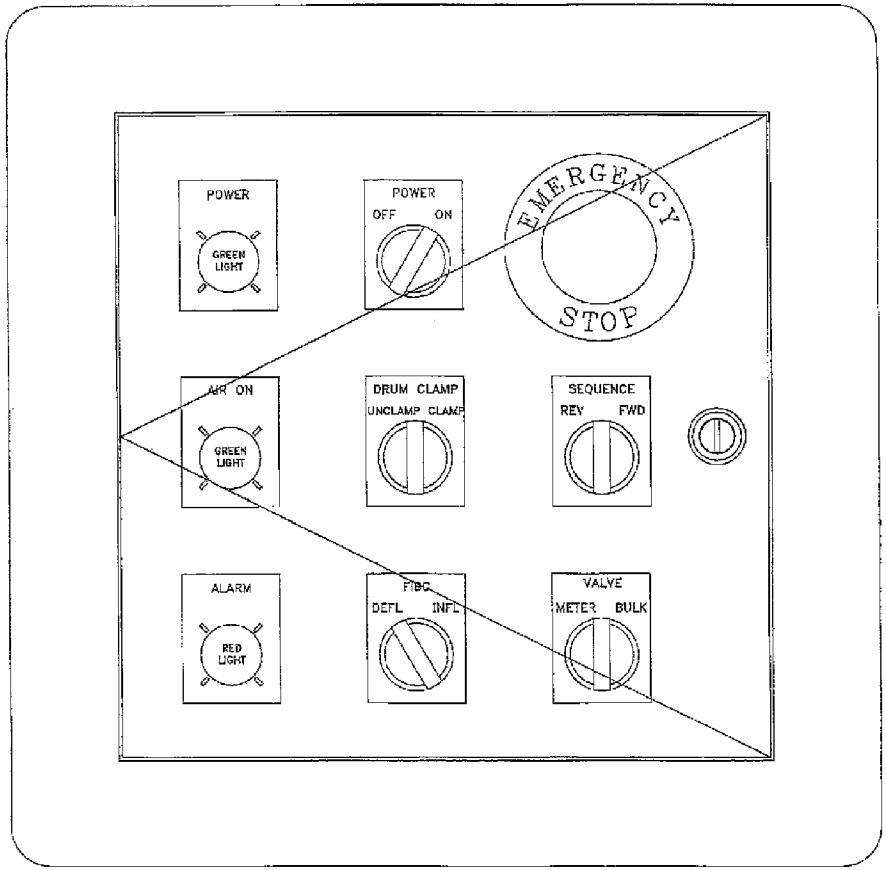

FIG. 10B is a front view of the operator/power panel of FIG. 10A.

Figures 11A, 11B, 11C:
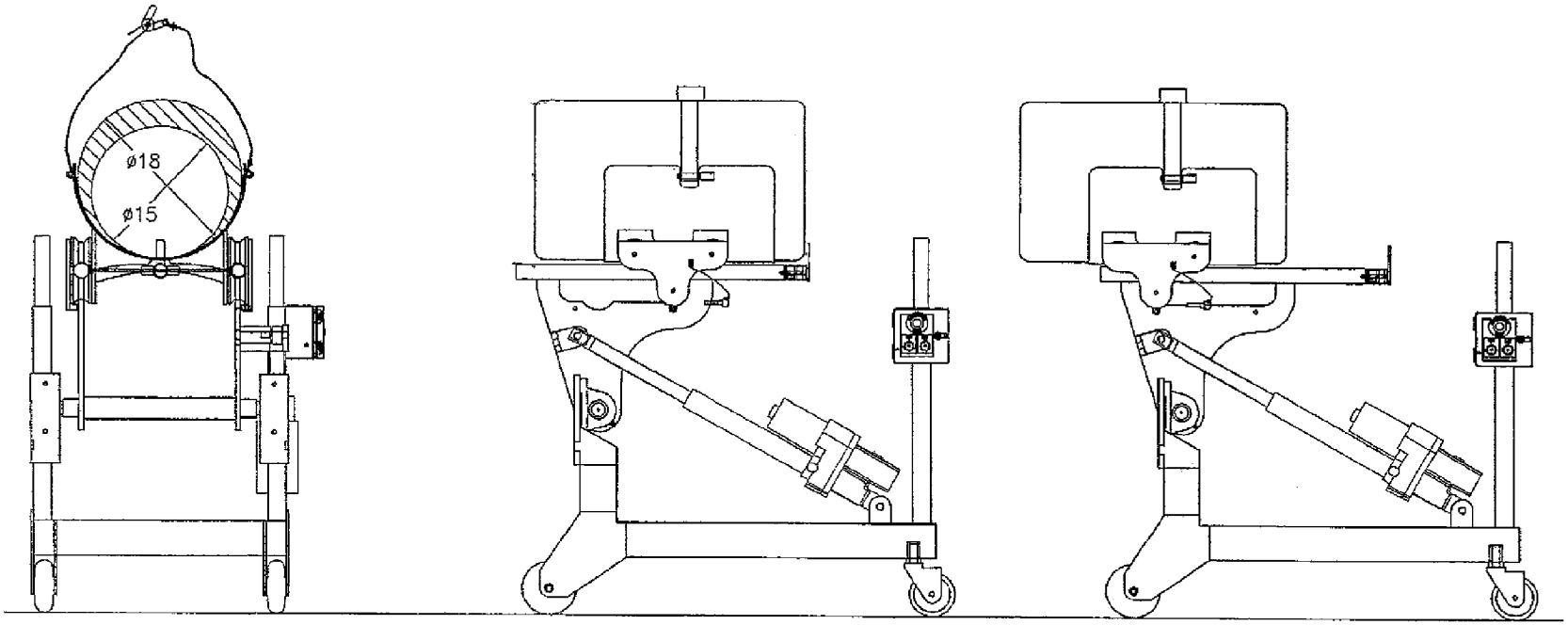

FIG. 11A illustrates an end view of a drum tipper assembly that is usable to transport the chemical drums to and from the cradle of the drum lifter/inverter machine of FIG. 1, FIG. 11B illustrates a side view of the drum tipper assembly of FIG. 11A, having a pivotable table being rotatable by an actuator, and with the drum being capable of being lowered to the floor, once correctly oriented, by a tray being slidable with respect to the table.

FIG. 11C is the side view of FIG. 11B, but with the drum having been translated laterally on the tray of the assembly.

DETAILED DESCRIPTION OF THE INVENTION

FIG. 1 shows a drum lifter/inverter machine 10 of the present invention, which includes a stanchion 20. Stanchion 20 may have a lower pivotal connection 21 to a base member 21B that may be secured to the floor 101 of a facility using bolts or another fastening means. The stanchion 20 may also have an upper pivotal connection 22 with a flange 22F that may be secured to the ceiling or other structure 102 using bolts or another fastening means.

Secured to, or formed integral with, the stanchion 20 may be an arm 25 that extends laterally therefrom. A first end 25*i* of arm 25 may cantilever away from stanchion 20 at a ninety-degree angle, and may be configured to be elevated relative to the stanchion using a lifting device within the stanchion. A second end 25*ii* of arm 25 may have a pivotal connection 25P with a cradle assembly 30. Cradle assembly 30 may comprise one or more arms 31/31B that may be used to partially encircle a drum 75 that may contain ingredients/materials (i.e., solids, liquids, powders, etc) necessary for the production of a commercial product. The arm(s) 31 may therefore be adapted to releasably grasp and/or be secured to the drum 75, to thereby be capable of lifting and moving, or otherwise assist in manipulating the position/orientation of the drum in relation to a mixing container arrangement 60 (see FIG. 3). A control panel for operating the drum lifter/inverter machine 10 is shown in FIGS. 10A and 10B, including controls for clamping onto the drum. Movement of the drum 75 about the floor 101 of the facility to permit its desired placement with respect to the cradle assembly 30 of the drum lifter/inverter machine 10, may be accomplished using the drum tipper assembly 90, as seen in FIGS. 1A-11C. Various sizes of the drum 75 may be accommodated by both the drum tipper assembly 90 and the drum lifter/inverter machine 10 (see e.g., FIG. 1D and Table 1).

The cradle assembly 30 may also comprise a support member 32 that may have a semi-circular shape. Support member 32 may be positioned on the cradle assembly 30 so as to be in-line with and form part of the pivotal connection 25P with arm 25. The semi-circular support member 32 may be used to support the cone-shaped funnel 40, which may comprise a generally conical shape. A first side of the semi-circular support member 32 may have a pivotal connection with the cone 40. As seen in FIG. 2, a lug 40L may protrude from the large end of the cone 40 and may therein receive the vertically oriented hinge pin 32Hv extending upward from the semi-circular support member 32, to provide for the pivotal connection between the semi-circular support member and the cone-shaped funnel.

An electric motor or other actuation means, including manual actuation, may supply torque to the cone to actuate it about that pivotal connection. As seen in the top view of FIG. 1B, use of the motor and this pivotal connection permits the cone to pivot 180 degrees or more, to be disposed away from the support member 32 of cradle assembly 30. After a drum 75 has been secured to the cradle assembly 30, the motor may then cause the cone to pivot backward, so as to again be centered over, and in-line with, the drum.

A plate 42P may protrude from a side of the large end of the cone-shaped funnel 40 (FIG. 1B), being opposite from the side with lug 40L, and may have a slotted opening therein. Once the cone 40 is re-positioned in this centered (in-line) position, it may be releasably secured to the support member 32 using a set screw 32S, the shaft of which may be received through the slotted opening in the plate 42P. Thereafter, the head of the set screw 32S may be torqued to clamp the plate 42P of cone 40 to the support member 32 (FIG. 1C). The narrow end of the cone 40 may transition into a cylindrical portion 40C. The cylindrical portion 40C of the cone 40 may include an iris valve 50 that may be opened or closed to control the flow of the ingredient out from the cone-shaped funnel, and hence to control flow of the ingredient out of the drum 75. The cone-shaped funnel 40 and the iris valve 50 are shown enlarged in FIG. 1C.

As seen in FIG. 3, a means of actuating the cantilevered arm 25 (vertically and rotationally) relative to stanchion 20 may be used to elevate the arm, and to thus elevate the drum 75 as well, upward toward the ceiling 102. The actuation means may include, but is not limited to, mechanical actuators (ball & screw; wheel and axle; hoist; winch; rack & pinion; chain drive; belt drive; and cam-types), hydraulic actuators, pneumatic actuators, piezoelectric actuators, and electro-mechanical actuators. Once elevated, a motor may supply torque to the pivotal connection 25P of the arm 25 to thereby rotate the cradle assembly 30 and drum 75 combination a full 180 degrees about the axis of arm 25, so as to have the material in the drum gravity free-fall toward the narrow end of the cone 40, to be stopped thereat by the iris valve 50. The rotatable stanchion 20 may then rotate about the axis of the stanchion, using another motor or by gearing and a mechanical connection to the motor causing torque to the arm 25, to have the inverted drum 75 be positioned over the mixing container arrangement 60.

The mixing container arrangement 60 may comprise any suitable arrangement, including, but not limited to, the one shown in FIG. 3, which is a flexible intermediate bulk container (FIBC) 61 that may be supported in an upright position by having its straps 61S be received by support rings 66 of a support frame 65. The FIBC 61 may be positioned atop a pallet 63, which may rest upon a scale 64 that may be used to weigh the ingredients added therein. The fill port 61F of the FIBC may be received onto the neck 67 of the support frame 65. An O-ring clamp 68 may be used to secure the port 61F of the FIBC with respect to the neck 67.

Toggling the iris valve 50 permits the material contained within the cone-shaped funnel 40 to flow from the drum 75 to the mixing container. However, one problem associated with the operation of this apparatus relates to the incomplete flowing of material out from the cone-shaped funnel 40 past the iris valve 50, as well as the cleaning of the cone after pouring of the material from the drum 75. To address this problem, a cone liner 80, as seen in FIG. 4, is particularly configured to be secured to the inside surface of the cone, to facilitate more complete removal of the material from the cone and the iris valve, to thereby reduce waste. The liner may also serve to more accurately maintain the proper relative proportion of that component material within the mixing container, by having a more accurate/complete emptying of the material from the drums into the container, particularly where an entire drum full of the ingredient is to be utilized.

The cone liner 80 may be made of material having a thickness preferably being in the range of 0.008 to 0.010 inches thick, but may vary outside that range, depending upon the particular material utilized. The liner may be made of a sheet or film, including, but not limited to, one or more of the following materials: polyethylene (PA); linear low, low, medium, or high density polypropylene (LLDPE, LDPE, MDPE, or HDPE); polypropylene (PP), cast polypropylene (CPP), and oriented polypropylene (OPP); polyamide (PA); polyester (linear ester plastics); a polyethylene (PE) such as polyethylene terephthalate (PET); Polyvinylchloride (PVC); polyvinylidene chloride (PVDC); cellulose acetate (CA); cellophane; and aluminum (Al).

The cone liner 80 may be formed with a first portion 81 having a hollow cylindrical section, which may match the dimensions of the interior surface of the cylindrical portion 40C of the cone 40 at its narrow end. The first portion 81 of liner 80 may transition into a hollow conical shape 82 to generally match the dimensions of the cone-shaped portion of funnel 40. Positioned a short distance 83 away from the wide end of the hollow conical shape 81 of liner 80 may be series of attachment members 84, that may be equally spaced circumferentially about the conical shape. The attachment members 84 may include, in part, a series of openings 85, which are described in greater detail in the following paragraphs.

FIG. 5 shows the drum 75 secured within the cradle assembly 30, and having the cone pivoted about the horizontally oriented hinge pin 32$H_h$. This permits the cone 40 to be oriented with its wide end facing upwards. In FIG. 6, the liner 80 is shown positioned above the cone 40, just prior to being inserted and mated with corresponding therein, which are shown enlarged within the detail view of FIG. 6A. The cone 40 may include a series of buttons 45 that may be secured to the interior surface 40I of the cone using adhesive, or mechanical fasteners, such as nuts and bolts, or by being welded thereto. Each of the buttons 45 may, as seen in FIG. 6A, be formed with a generally cylindrical head 45H that may sit atop a cylindrical shaft 45S. The side of the cylindrical head 45S being opposite to the shaft may have its outer edge chamfered or rounded, for more easily receiving the openings of the liner over the head. The diameter of the head 45H may preferably be larger than the diameter of the shaft 45S. The buttons 45 may be equally spaced circumferentially about the wide end of the cone 40, using the same spacing as is used for the openings 85 of the cone liner 80. As seen in FIG. 7, the distance that the buttons 45 are located from the end of the cone 40 may be such that the cone liner may install within the cone with its conical portion 81 contacting and being closely supported by the conical wall of the cone 40. The installation may occur by dropping the liner 80 into the cone 40 and by hooking the series of opening 85 of the liner 80 onto the buttons 45 of the cone 40. Next, the hollow cylindrical section 82 of the liner may be pulled taut through the cylindrical portion 40C of the cone and through the iris valve 50. The valve may then be closed to cinch the cylindrical end of the liner 80, as seen in FIG. 8. FIG. 8 also shows the cone 40, with liner 80 installed therein, after having been rotated about hinge pin 32$H_h$ to be in-line with the drum 75 held within cradle assembly 30, and with the cinched end 80C of the liner 80 protruding upwardly from the upper cylindrical portion of the cone.

During the process of mounting the openings 85 of the liner 80 over the head 45H of buttons 45 to initially hang from the cylindrical shaft 45S of the buttons, there was a tendency for the liner to be susceptible to being accidentally pulled off of the opposite side that had already been hung on the buttons, particularly where an opening 85 of sufficient clearance was used on the liner 80, with respect to the diameter of the head 45H of the button 45. In addition, once the liner is initially hanging from the buttons, when the operator was subsequently reaching to pull the cylindrical portion 81 of the liner 80 through the corresponding cylindrical portion 40C of the cone and through the iris valve 50, there was also a tendency to tear the liner openings on the shaft 45S of the buttons 45. Increasing the thickness of the cylindrical portion of the liner and the conical portion of the liner, which may already be different for various design considerations, would waste material. Instead, forming an integral grommet 86 about the periphery of the opening 85 would better operate to withstand the tendency towards tearing. Furthermore, slightly undersizing the diameter of the openings 85 and of the integral grommet 86 would also serve to resist the problem of the liner being pulled off from the opposite side, but conversely made the liner somewhat more difficult and cumbersome to be hung from the buttons of the cone. Oversizing of the openings 85 caused another undesirably tendency, being that when the cone is rotated back over the drum, as seen in the cone being moved from its position in FIG. 7 to its position in FIG. 8, there was a tendency of the liner on the leading side to become dislodged from at least one of the buttons. A solution for all of the above disclosed problems was found through shaping of the openings 85 to be elliptical, and by integrally forming a corresponding grommet. The grommet is defined by driving a circle along the elliptical opening to enclose a volume, which is similar to a torus (Note- a torus is defined by a circle being driven to enclose a surface by being driven along another circle as its centroid). For the current invention, a planar ellipse may be used to approximate the opening, which would actually be made in a conically-shaped liner, as the curvature of the conical liner is large in relation to the size of the grommet, and so the cone can be locally approximated to be planar. For the current invention, the centroid is an ellipse 85E with major and minor radii of "a" and "b," which is defined, as seen in FIG. 4B, by the following equation:

$$R(\theta)=ab/\sqrt{(b\ \mathrm{Cos}\ (\theta))^2+(a\ \sin\ (\theta))^2}$$

The corresponding local "x" and "y" locations of any point on the elliptical opening are therefore given by the following equations:

$$x=R(\theta)\cdot\cos(\theta)$$

$$y=R(\theta)\cdot\sin(\theta)$$

The circle being driven to define the exterior surface of the grommet, is the circle 86C of radius "r." Parametric equations to describe this surface to form the grommet are as follows:

$$X(\theta,\phi)=\cos(\theta)\cdot(r\,\mathrm{Cos}(\phi)+ab/\sqrt{(b\,\mathrm{Cos}(\theta))^2+(a\sin(\theta))^2})$$

$$Y(\theta,\phi)=\sin(\theta)\cdot(r\,\mathrm{Cos}(\phi)+ab/\sqrt{(b\,\mathrm{Cos}(\theta))^2+(a\sin(\theta))^2})$$

$$Z(\theta,\phi)=r\cos(\phi)$$

The circumference of the opening of the elliptical grommet may be undersized with respect to the circumference of the head 45H of the button 45. However, for ease of installation of the liner 80, as discussed previously, the circumference of the opening of the elliptical grommet may instead be sized to be approximately the same, or to be even slightly larger, because once installed onto the button, the elliptical shape of the grommet serves to pre-load the liner with respect to the shaft of the buttons, so that those regions proximate to the minor radii of the elliptical grommet tend to engage with the shaft 45S, below the below the head 45H of the button 45, thereby working to prevent it from being dislodged.

FIG. 9 illustrates the relationship between the drum 75 and the liner 80, as installed within the cone 40. The drum chime 75C may be positioned clear of the liner, but in a preferred embodiment, the arrangement may result in the drum chime contacting the liner to be sealed and clamped against it. The position of contact may be at a point beyond where the series of holes 85 of the liner 80 are hooked onto the buttons 45 (i.e., the diameter of the drum chime 80C may be smaller than the diameter of the cone at the level at which the buttons are secured).

Overall operation of the apparatus may be as follows. A pallet 63, as seen in FIG. 3, may be positioned on top of a scale 64, both of which may be positioned beneath the support frame 65. The straps 61S of the flexible intermediate bulk container (FIBC) 61 may be received by the support rings 66 of the support frame 65. The fill port 61F of the FIBC may be received onto the neck 67 of the support frame 65 and the O-ring clamp 68 may secure the port 61F to the neck 67. The liner 80 may be secured within the cone-shaped funnel 40, as seen in FIGS. 6 and 7. Next, the cone 40 and cradle 30 may be positioned for loading of the drum. The cone may be manually swung into the closed position, as seen in FIG. 8. The locking knob, in the form of set screw 32S, may be manually tightened, until the cone 40 is fully secured to the cradle assembly 30, The drum 75 may be properly positioned (centered in the cradle) in order for the drum to be clamped therein. The "DRUM CLAMP" selector switch of the operator/control panel of FIG. 10B may be turned to the "CLAMP" position. An actuator will cause the base 31B of the cradle and the drum 75 (FIG. 1) to rise, clamping the chime 75C of the drum against the liner 80 on the inside of the cone-shaped funnel 40 (see FIG. 9). The operator may visually inspect the drum 75 to verify that it is fully clamped and secure in the cradle and the cone. The operator may turn the "SEQUENCE" switch in FIG. 10B to the "FWD" position, and manually hold it there. (Note-releasing the switch at any time will stop all motion, and the operator may restart the motion by simply turning the switch back to "FWD"). The lift will elevate the drum to a preset height relative to stanchion 20, and invert the drum 75. The preset height will be a height at which slewing of the clamped drum may occur (e.g., rotating of the stanchion). The lift will slew the cylindrical cone outlet 40C to be directly above and centered over the FIBC 61, as seen in FIG. 3. The lift will lower the drum/cone until the outlet is engaged with the dust cap 62 of the charge port, and then stop. The operator may next turn the "FIBC" switch of the operator/control panel of FIG. 10B to "INFL" to cause a blower to inflate the container. The "VALVE" switch may be turned to "BULK" to open the iris valve 50 to thereby cause a large volume of product to empty from the cone liner/drum, into the FIBC 61. The "VALVE" switch may alternatively be turned to "METER" to narrowly open the iris valve 50 and thereby add small amounts of product to the FIBC, where the total amount added may be measured by the scale 64, which may have been zeroed before the start of the discharging of the product into the FIBC 61. Product may be released until the desired weight of the product has been received within FIBC 61, or until the entire drum and cone liner have been relieved of the product therein. The liner may serve to facilitate this more complete removal.

The reverse operation for the apparatus may be as follows. The operator may release the "VALVE" switch to close the iris valve 50, to cease the discharge of product from the drum 75. A portion 80C of the liner 80 will again be crimped, as was shown in FIG. 8. The operator may next select and hold "REVERSE" from the "SEQUENCE" selector switch. (Note- releasing the switch at any time will stop all motion, and the operator may restart the motion by simply turning the switch back to "REVERSE"). The lift will raise the drum 75 back to the maximum slew height. The lift will then slew back to the original position above where the drum(s) was/were loaded. The lift will lower the clamped drum 75 to a preset height, and then rotate the drum to be upright. The lift will then lower the drum 75 to the loading position and stop, at which time the SEQUENCE" selector switch may be released by the operator. The "DRUM CLAMP" selector switch of the operator/control panel of FIG. 10B may be turned to the "UNCLAMP" position, and the base 31B of the cradle and the drum 75 will lower, unclamping the chime 75C of the drum from its position against the liner 80 on the inside of the cone-shaped funnel 40 (FIG. 2). The operator may manually unscrew the set screw 32S, until the cone 40 is fully disengaged from the cradle assembly 30. The cone may be manually swung into the open position, as seen in FIG. 5. The drum may be transported away from the machine, and other drums be positioned therein for additional discharge into the FIBC 61, as desired. After the FIBC is fully charged, the operator may next turn the "FIBC" switch of the operator/control panel of FIG. 10B to "DEFL" to remove excess air from the. FIBC 61.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. A flexible liner for use with a cone-shaped funnel of a drum lifter/inverter mixing machine, said liner comprising:

a first portion, said first portion formed into a hollow cylinder having a first end and a second end, and formed with a first diameter;

a second portion, said first portion of said liner configured to transition into a first end of said second portion; said second portion comprising a conical shape with said first end formed to said first diameter, and a second end of said second portion formed to a second diameter; said second portion comprising a plurality of elliptically-shaped openings, with a center of each positioned a first distance away from said second end, with a major axis of each oriented substantially parallel to a slant height of said conical shape, and with said plurality of elliptically-shaped openings being equally spaced about a third diameter of said second portion; and an elliptically-shaped grommet formed at each said elliptically shaped opening.

2. The flexible liner of claim 1 wherein said liner is formed of an elastomeric material.

3. The flexible liner of claim 2 wherein said liner is formed of a material from the group of materials consisting of polyethylene (PA); linear low, low, medium, or high density polypropylene (LLDPE, LDPE, MDPE, or HDPE); polypropylene (PP), cast polypropylene (CPP), and oriented polypropylene (OPP); polyamide (PA); polyester (linear ester plastics); a polyethylene (PE); Polyvinylchloride (PVC); polyvinylidene chloride (PVDC); cellulose acetate (CA); and cellophane.

4. The flexible liner of claim 2 wherein said first portion of said liner comprises a first thickness, and said second portion of said liner comprising a second thickness.

* * * * *